US007089620B2

(12) United States Patent
Stoll

(10) Patent No.: US 7,089,620 B2
(45) Date of Patent: Aug. 15, 2006

(54) METHOD FOR WASHING LAUNDRY IN A TANK-FREE WASH PATH AS WELL AS WASH PATH FOR CARRYING OUT THE METHOD

(75) Inventor: Karl-Heinz Alexander Stoll, Wiesbaden (DE)

(73) Assignee: Senkingwerk GmbH, Hildesheim (DE)

( * ) Notice: Subject to any disclaimer, the term of this patent is extended or adjusted under 35 U.S.C. 154(b) by 641 days.

(21) Appl. No.: 09/908,720

(22) Filed: Jul. 20, 2001

(65) Prior Publication Data

US 2002/0038481 A1 Apr. 4, 2002

(30) Foreign Application Priority Data

Aug. 16, 2000 (DE) ..... 100 39 904

(51) Int. Cl.
*D06F 31/00* (2006.01)

(52) U.S. Cl. ..... 8/159; 68/27; 68/58; 68/902

(58) Field of Classification Search ..... 68/9, 68/18 R, 902, 48, 24, 58, 27, 140, 143, 142; 8/158, 159

See application file for complete search history.

(56) References Cited

U.S. PATENT DOCUMENTS 3,210,969 A * 10/1965 Sulzmann
3,293,891 A * 12/1966 Sulzmann
3,473,884 A * 10/1969 Drtina et al. ..... 8/108.1
3,918,112 A * 11/1975 Sabit
4,363,090 A * 12/1982 Garcia
4,478,060 A * 10/1984 Gruenwald
4,546,511 A * 10/1985 Kaufmann
4,616,372 A * 10/1986 Stoll ..... 8/158
4,694,665 A * 9/1987 Stoll
4,858,107 A * 8/1989 Stoll
4,879,887 A * 11/1989 Kagiu et al.
5,307,652 A * 5/1994 Hagiwara et al.
5,333,475 A * 8/1994 Edmundson et al.
5,426,958 A * 6/1995 Sheppard
6,277,153 B1 * 8/2001 Van Kouwen et al.

FOREIGN PATENT DOCUMENTS

CH 660046 * 3/1987
DE 3346690 * 7/1985
DE 43 31 704 A1 2/1995
GB 2000526 * 1/1979
GB 2066302 * 7/1981
JP 1-306669 * 12/1989
JP 5-68768 * 3/1993

OTHER PUBLICATIONS

European patent office 636,731 Feb. 1995.*

* cited by examiner

*Primary Examiner*—Frankie L. Stinson
(74) *Attorney, Agent, or Firm*—Birch, Stewart, Kolasch & Birch, LLP

(57) ABSTRACT

A method for washing laundry and a wash path for laundry in bath change and/or counterflow operation, in which the laundry to be washed when passing through said wash path moves through different treatment zones with chambers 1 to 16, wherein the individual baths are composed of fresh water and waste water of other baths, wherein the waste water of at least one bath without intermediate storage and directly is at least partly supplied to another bath, and wherein no waste water is intermediately stored in the water circulation during washing.

21 Claims, 2 Drawing Sheets

METHOD FOR WASHING LAUNDRY IN A TANK-FREE WASH PATH AS WELL AS WASH PATH FOR CARRYING OUT THE METHOD

This application claims priority from German Application No. 100 39 904.5. filed Aug. 18, 2000.

BACKGROUND OF THE INVENTION

The invention relates to a method for washing laundry, in which the laundry to be washed is moved through a wash path having subsequent chambers with different baths, wherein said laundry passes at least one of the following zones: prewashing zone, clearwashing zone, rinsing zone and after-treatment zone, and the wash water of the individual paths is composed of fresh water or fresh water and waste water of other baths. The invention further relates to a wash path for laundry in bath-change and/or counterflow operation with a washing drum with several subsequent chambers for a plurality of baths in said washing drum and a conveyor means for transferring the laundry through said washing drum as well as at least one fresh water inlet position and at least one waste water drawing-off position and inlet position for water discharge and charging.

In continuous wash paths the laundry to be washed is introduced into a washing drum on one side, which comprises a plurality of subsequent washing chambers. By the rotation of said washing drum or a separate conveyor means the laundry is transferred through said washing drum and the different chambers or baths, respectively, for thereby being washed. Such continuous wash paths are operated in bath change operation as well as in counterflow operation. Also a combined operating mode from bath change and counterflow method is known.

The individual chambers of said wash path are correlated to definite zones in which the laundry is subjected to a treatment. Thus, e.g. in a wash path working in bath change mode a difference is made between a prewashing zone, a clearwashing zone, a rinsing zone and an aftertreatment zone which is followed by a drainage means like e.g. a press or centrifuge. In a wash path working in counterflow mode a difference is made between a first prewashing zone, a second prewashing zone, a clearwashing zone, a rinsing zone and an aftertreatment zone which is followed by the drainage means.

In washing with wash paths unused baths are used to prepare the prewashing bath in the prewashing zone, the clearwashing bath in the clearwashing zone (in case of bath change or counter flow) or in addition one or several bath changes for the subsequent laundry. These baths partially are clearwashing water, the rinsing water or the press water occurring in a drainage means like e.g. a press or centrifuge. These waters are recovered and e.g. leave said rinsing zone either through one or several overflows, through drain valves or together with the laundry when the latter leaves the machine or turn up at the drainage means.

Due to the constant flow direction changes of the inner drum of said wash path as well as by different water piling-ups during passage of the laundry and the separation walls in counter flow this water, however, does not turn up in uniform flow but in gushes in intervals which cannot be controlled. Therefore, also the distribution of the water in the different outlet positions varies. Since in the positions where said water is used again accurately defined amounts are required at an accurately defined time, it is necessary to collect the different waters in buffer tanks and from there to distribute accurately measured amounts to the positions of consumption. Said buffer tanks, however, include the disadvantage that they are very expensive in production, have high demand in space and have to be cleaned more frequently for hygienic reasons. As they, however, usually are arranged below the wash paths, in most cases they are accessible with difficulty only so that cleaning of the lint seaves, removal of sand and objects is very consumptious and, therefore, expensive.

SUMMARY OF THE INVENTION

It is, therefore, the object of the present invention to propose a washing method and to make available a wash path, in which the washing process is simplified, efficiency of the plant is improved substantially and the costs for manufacture and operation can be decreased. Simultaneously a good washing result is to be guaranteed with low water consumption and the maintenance at the machine is to be facilitated.

Said object is solved in advantageous manner by the method in accordance with the invention under claim 1 as well as a wash path as defined in claim 13. Preferred embodiments are subject of the subclaims subordinate to said claims.

The above-described object in advantageous manner is solved in that the reusable recovered baths are not removed by overflows or outlets of the machine and intermediately are stored for then again being recharged to the machine in the required amount, but directly in the position where they occur the waste waters in exactly the required amount are pumped to the position of the wash path where they actually are needed. Buffer tanks showing the above-described drawbacks are completely omitted in advantageous manner so that the construction of a novel wash path in accordance with the invention is improved already by saving material costs but also by constructional simplification substantially, while simultaneously maintenance is made easier. In the subclaims preferred features are cited which state with respect to the method and the apparatus in which way waste water is taken from the partial zones of the wash path and again partially is supplied to preceding zones. The washing water therein variably is composed of fresh water and waste water, this being effected depending on the waste water portion so that in the respective zone a suitable amount of wash water is available. The waste water which in advantageous manner is continually taken out in exactly defined amount can be mixed with other waste water that is taken out from another zone region of the wash path as also with fresh water so that a suitable mixing ratio is adjusted. Therein, the waste water is taken out e.g. in the beginning of the rinsing zone and/or in the beginning of the aftertreatment zone and/or from a drain means located at the end of the wash path, wherein a press or a centrifuge can be used as drain means and the washing operation of pressing out the humidity from the readily washed laundry is included. Without being stored intermediately, the waste water of these zones in advantageous manner is lead to the prewashing zone. Furthermore, the waste water of the clearwashing zone can be supplied to a preceding chamber of the clearwashing zone or the waste water of the rinsing zone can be supplied to a preceding chamber of the rising zone.

When considering a washing machine in counterflow principle in which two prewashing zones are provided for it is possible that the waste water of the clearwashing zone and/or of the rinsing zone and/or of the drain means is supplied to a first prewashing zone and/or a second prewashing zone. Excess waste water not fed back to the wash path can be removed or recovered.

The wash path in accordance with the present invention in advantageous manner comprises a water recovery system whose water-carrying components exclusively consist of direct water-transferring lines between water supply positions and water removal positions without any water storage components. A valve and pump system can be provided for for regulation of the water flows in a manner known per se in the water recovery system and/or in a fresh water supply. Therein, the water recovery system comprises water removal positions permitting an exactly defined water removal e.g. using inductive throughput meters or a time measurement means. Therein, the water supply positions can be connected to at least two or several water removal positions. The wash path including at least one prewashing zone, one clearwashing zone, one rinsing zone and one aftertreatment zone comprises a water recovery system comprising water removal positions in the end of the clearwashing zone and/or in the end of the rinsing zone and/or of the aftertreatment zone, said water removal positions being directly connected by lines with supply positions in the prewashing zone and/or clearwashing zone and/or rinsing zone. Said lines in addition are equipped with outlets including valves, through which e.g. also a disposal of waste water into the sewage system or also, however, recovery can be achieved. It can be provided for in advantageous manner that a drain means, a wash press in particular for pressing the washed laundry or a centrifuge are connected to the wash path, whose water removal position is connected to the prewashing zone through a line directly. The drum of the wash path can at least in the area of the water removal positions be formed as double drum, the inside wall of the drum being punched in the region of the double drum construction.

Further features, advantages and details of the invention result from the following description of preferred embodiments with reference to the drawing.

DETAILED DESCRIPTION OF PREFERRED EMBODIMENT

Figure 1:
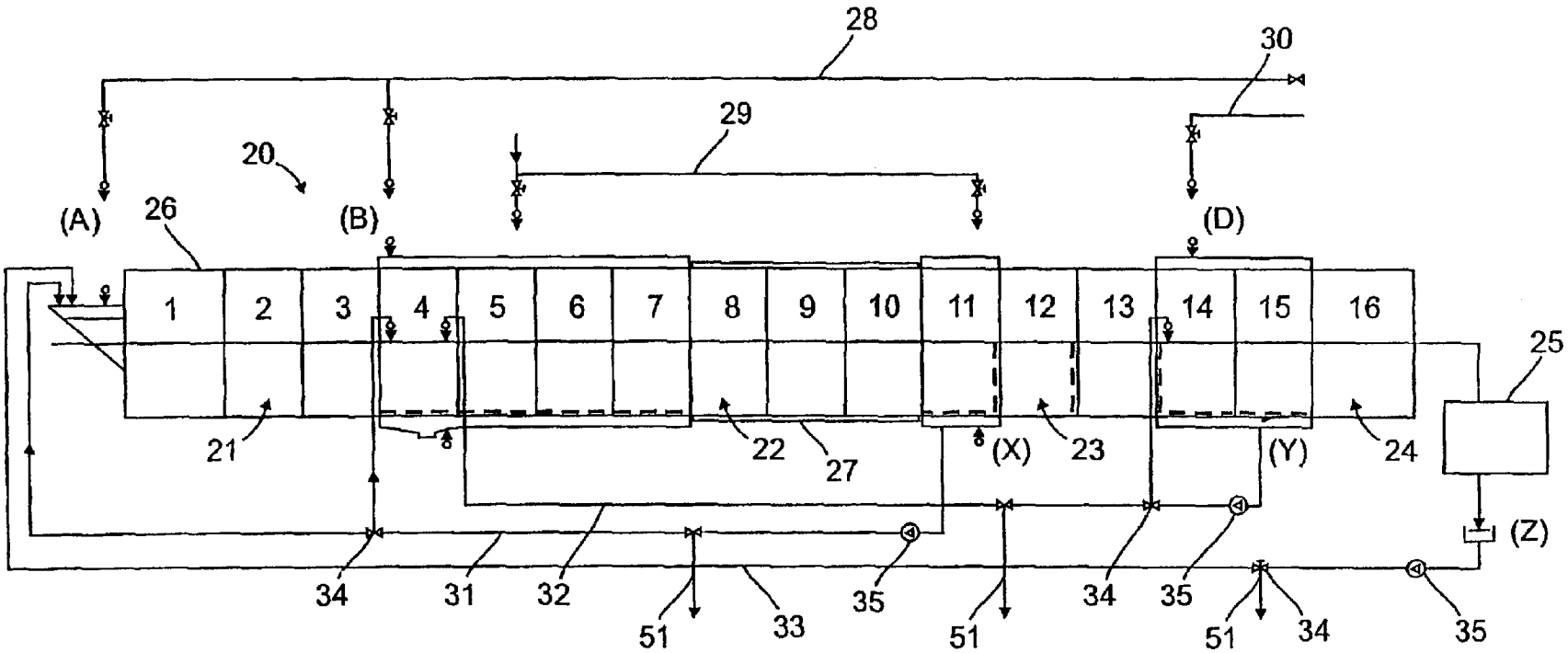
FIG. 1 is a schematic view of a wash path working with bath change.

In the wash path 20 and 16 schematically shown in FIG: 2, chambers 1 to 16 are provided for which have to be correlated to the following zones:

| | |
|---|---|
| chambers 1 to 4 | prewashing zone 21 |
| chambers 5 to 10 | clearwashing zone 22 |
| chambers 11 to 14 | rinsing zone |
| chambers 15 to 16 | aftertreatment zone 24 |

Said aftertreatment zone 24 can be followed by a drain means 25, like e.g. a press or a centrifuge.

As can be seen from FIG. 1, said chamber 1 to 16 of said wash path 20 are arranged in a drum 26 formed as double drum in the area of said chambers 4 to 7, 11 and 14 to 15. In these areas the inside wall of said drum is made punched whereas it is provided with an isolation 27 in the area of said chambers 8, 9, 10. Hereby, it is avoided that heated waters supplied from a boiler through the fresh water line 28 and/or waters, respectively, heated with addition through the vapor line 29 cools down too early in the region of the clearwashing zone.

As can be seen with reference to the schematic drawing under FIG. 1, the fresh water supplied at a temperature of 35° C. or more is fed to the said wash path in the region of said prewashing zone 26. Vapor can be introduced into said chambers 5 and 11 through said vapor lien 29. Finally, cold water is supplied to said chamber 14 through line 30.

Water removal positions for taking out waste water are provided for, marked with X at said chamber 11, with Y at said chamber 15 and with Z at said drain means 25. Water supply positions are marked with letters A, B and D. It can be seen that e.g. the waste water line X is directly connected either to the water supply position A or B, while the water removal position Y is connected to the water supply position B through a direct connecting line 32 and finally the waste water removal position Z is connected to the water supply position A through a connecting line 33. Clearwashing water removed from said clearwashing zone 22, which still contains substantial substances of detergents, can therefore be recovered and supplied to said chamber 1 and/or 4, respectively, of said prewashing zone directly. Rinsing water taken out from said chamber 15 in the end of said rinsing zone 23 can either be led to chamber 4 of said prewashing zone or, however, to chamber 14 of said rinsing zone, while the cold water from the press can be supplied to said prewashing zone through the line 33.

As can be seen, valves 34 and pumps 35 are provided for in the lines, though which a dosed charging of said water supply positions with waste water can be adjusted. During operation of the above-described wash path now waste water removed from said water removal positions, Y and Z is directly pumped through said corresponding lines 31, 33, 33 to said water supply positions A, B and D, for which purpose preferably pumps 35 are provided for which are indifferent to impurities/pollutions, like e.g. fluffing contained in the waste water. In the water supply positions the washing water not yet polluted too much, from the end regions of said wash path is added to the wash drum in the area of the baths in which the laundry to be washed still has a strong degree of pollution. Thus, e.g. the almost clean press water from the removal position Z of said laundry press can very well be used in the region of prewashing for there soaking the laundry and liberating it from severe dirt. The use of waste water from the clearwashing zone in addition has the advantage that said water already is heated so that no strong heating of the washing water in the clearwashing one is required, as such were the case when using only fresh water.

Figure 2:
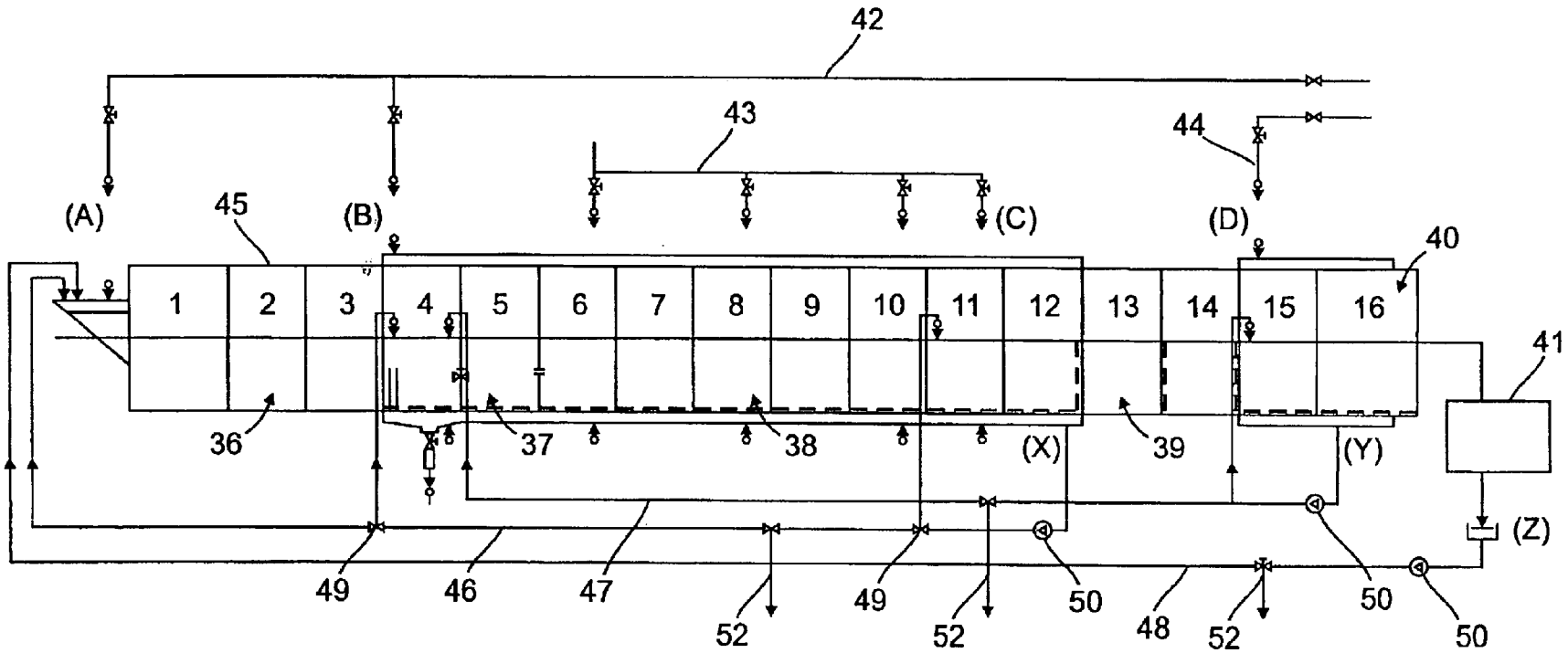
FIG. 2 is a schematic view of a wash path working in counterflow operation.

The wash path shown in FIG. 2 works in counterflow operation and includes the following zones:

| | |
|---|---|
| chambers 1 to 3 | 1st prewashing zone 26 |
| chambers 4 and 5: | 2nd prewashing zone 37 |
| chambers 6 to 11: | clearwashing zone 38 |
| chambers 12 to 15: | rinsing zone 39 |
| chamber 16: | aftertreatment zone 40 |

Said aftertreatment zone 40 is followed by the drain means 41.

The waste water removal positions also are marked with letters X, Y and Z and are located in said chambers 12 and/or 16, respectively, and/or at the outlet of said drain means 41. In addition to said water supply positions A, B and D the water supply position C is provided for in said chamber 11.

Through the fresh water line 42 preheated fresh water reaches the water supply positions A and B in the beginning of said first prewashing zone 36 and/or in the beginning in chamber 4 of said second prewashing zone 37. Vapor is introduced to the clearwashing zone through the vapor line 43 at said chambers 6, 8, 10 and 11. Finally, fresh water supply is effected through the fresh water line 44 at the water supply position D in chamber 15.

As can be seen, the drum 45 is formed as double drum in the region of said chambers 4 to 12 and 15 and 16, the inner wall of said drum being punched, this being indicated by the dashed line.

The outlined line scheme reveals that said waste water removal position X is connected to said water supply position 1 and/or said second prewashing zone chamber 4 at said water supply position B and/or said water supply position C in said chamber 11 of said clearwashing zone through the connecting line 46. Furtheron, said water removal position Y on one hand is connected to said water supply position B of said chamber 4 of said second prewashing zone and on the other hand—with said water supply position D of said chamber 15 of said rinsing zone. And finally said water removal position Z of said drain means is connected to said water supply position A in the beginning of said first prewashing zone through the connecting line 48. Similar to the embodiment under FIG. 1, valves 49 and pumps 50 are provided for in all lines so that dosed supply of waste water to the individual chambers is possible. In the embodiments 1 and 2 said connecting lines 31, 32 and 33 and/or 46, 47, 48 are provided with outlets 51 and/or 52, through which waste water portions can be led into the sewage system or a recovery system.

LIST OF REFERENCE NUMBERS

| | |
|---|---|
| 1 to 16 | chamber |
| 20 | wash path |
| 21 | prewashing zone |
| 22 | clearwashing zone |
| 23 | rinsing zone |
| 24 | aftertreatment zone |
| 25 | drain means |
| 26 | drum |
| 27 | isolation |
| 28 | fresh water line |
| 29 | vapor line |
| 30 | fresh water line |
| 31 | connecting line |
| 32 | connecting line |
| 33 | connecting line |
| 34 | valve |
| 35 | pump |
| 36 | 1st prewashing zone |
| 37 | 2nd prewashing zone |
| 38 | clearwashing zone |
| 39 | rinsing zone |
| 40 | aftertreatment zone |
| 41 | drain means |
| 42 | fresh water line |
| 43 | vapor line |
| 44 | fresh water line |
| 45 | drum |
| 46 | connecting line |
| 47 | connecting line |
| 48 | connecting line |
| 49 | valve |
| 50 | pump |
| 51 | outlet |
| 52 | outlet |
| A, B, C, D | waste water supply positions |
| X, Y, Z | waste water removal positions |

What is claimed is:

1. A method for washing laundry, in which said laundry to be washed is moved through a wash path with subsequent chambers with different individual baths, wherein said laundry passes at least two of the following zones: prewashing zone, clearwashing zone, rinsing zone and aftertreatment zone, and the washing water of the individual baths in the at least two zones includes a variably controlled ratio of fresh water and waste water of other baths, wherein said waste water of at least one zone is recovered and at least partly is directly supplied to at least one other zone, and wherein no waste water is stored intermediately in the washing water circulating during washing.

2. The method according to claim 1, wherein said waste water at least partly is supplied to at least one preceding zone.

3. The method according to claim 1, wherein depending on the waste water occurrence a sufficient amount of washing water is available.

4. The method according to claim 1, wherein said waste water is continually removed in an exactly defined amount.

5. The method according to claim 1, wherein said waste water is led to said clearwashing zone of a preceding chamber of said clearwashing zone.

6. The method according to claim 1, wherein said waste water is supplied to said rinsing zone of a preceding chamber of said rinsing zone.

7. The method according to claim 1, wherein excessive waste water not supplied back to the wash path is removed or recovered.

8. A method for washing laundry, in which said laundry to be washed is moved through a wash path with subsequent chambers with different baths, wherein said laundry passes at least one of the following zones:

prewashing zone, clearwashing zone, rinsing zone and aftertreatment zone and the washing water of the individual baths is composed of fresh water, or fresh water and waste water of other baths, wherein said waste water of at least one zone is recovered and at least partly is directly supplied to at least one other zone, and wherein no waste water is stored intermediately in the water circulation during washing and wherein the water added in a defined area of said wash path is taken from at least two waste water removal positions and is used in a preferably adjustable mixing ratio.

9. A method for washing laundry, in which said laundry to be washed is moved through a wash path with subsequent chambers with different individual baths, wherein said laundry passes at least two of the following zones:

prewashing zone, clearwashing zone, rinsing zone and aftertreatment zone, and the washing water of the individual baths in the at least two zones includes a variably controlled ratio of fresh water and waste water of other baths, wherein said waste water of at least one zone is recovered and at least partly is directly supplied to at least one other zone, wherein no waste water is stored intermediately in the water circulation during washing, and wherein said waste water is taken from at least one of the beginning of said rinsing zone, the beginning of said aftertreatment zone from a drain means following said wash path.

10. The method according to claim 9, wherein a press or centrifuge is used as said drain means and said washing operation includes pressing humidity out of the readily washed laundry, the waste water gained therein also being supplied to the wash path without intermediate storing.

11. The method according to claim 9, wherein said waste water of at least one of said clearwashing zone, said rinsing zone and said drain means is led to the prewashing zone.

12. The method according to claim 9, wherein said waste water of at least one of said clearwashing zone said rinsing zone, and said drain means is supplied to at least one of a first prewashing zone and a second prewashing zone.

13. A wash path for laundry in bath change and/or counterflow operation comprising:

a wash drum with several subsequent chambers for a plurality of baths in said wash drum, a transfer means for transferring said laundry through said wash drum, and at least one fresh water supply position and at least one waste water removing and supply position for water removal and water supply, wherein said wash path comprises a water recovery system whose water-carrying components exclusively consists of direct lines transferring water between water supply positions and water removal positions without any water storage component and wherein said water supply recovery system comprises water removal positions which permits an exactly defined water removal.

14. The wash path according to claim 13, wherein said lines are equipped with outlets containing valves.

15. The wash path according to claim 13, wherein a drain means is connected to said wash path and wherein a laundry press for pressing the washed laundry or a centrifuge, includes a water removal position directly connected to said prewashing zone through a line.

16. The wash path according to claim 13, wherein said water recovery system comprises valves for controlling the amounts of water in said lines.

17. The wash path according to claim 15, wherein said drum of said wash path at least in the region of said water removal positions is formed as double drum.

18. A wash path for laundry in bath change and/or counterflow operation comprising:

a wash drum with several subsequent chambers for a plurality of baths in said wash drum, a transfer means for transferring said laundry through said wash drum, and at least on fresh water supply position and at least one waste water removing and supply position for water removal and water supply, wherein said wash path comprises a water recovery system whose water-carrying components exclusively consist of direct lines transferring water between water supply positions and water removal positions without any water storage component and wherein said wash path comprises water supply positions which are connected to at least two water removal positions.

19. A wash path for laundry in bath change and/or counterflow operation comprising:

a wash drum with several subsequent chambers for a plurality of baths in said wash drum, a transfer means for transferring said laundry through said wash drum, and at least one fresh water supply position and at least one waste water removing and supply position for water removal and water supply, wherein said wash path comprises a water recovery system whose water-carrying components exclusively consist of direct lines transferring water between water supply positions and water removal positions without any water storage component and wherein said water recovery system comprises water removal positions which permit an exactly defined water removal.

20. A wash path for laundry in bath change and/or counterflow operation comprising:

a wash drum with several subsequent chambers for a plurality of baths in said wash drum, a transfer means for transferring said laundry through said wash drum, and at least one fresh water supply position and at least one waste water removing and supply position for water removal and water supply, wherein said wash path comprises a water recovery system whose water-carrying components exclusively consist of direct lines transferring water between water supply positions and water removal positions without any water storage component and wherein said wash path comprises at least a pre-washing zone, a clearwashing zone, a rinsing zone and an aftertreatment zone, and wherein said water recovery system comprises water removal positions in at least one of the end of said clearwashing zone, in the end of said rinsing zone, and said aftertreatment zone, which are directly connected to supply positions in at least one of said prewashing zone, clearwashing zone, and rinsing zone through lines.

21. The wash path according to claim 17, wherein an inside wall of said drum is punched in an area of double drum formation.

* * * * *